US007548207B1

(12) United States Patent
Chu et al.

(10) Patent No.: US 7,548,207 B1
(45) Date of Patent: Jun. 16, 2009

(54) CIRCULARLY POLARIZED ANTENNA

(75) Inventors: Fang-Hsien Chu, Taipei County (TW); Hua-Ming Chen, Taipei County (TW); Yang-Kai Wang, Taipei County (TW); Ching-Shun Wang, Taipei County (TW)

(73) Assignee: Advanced Connection Technology, Inc., Taipei County (TW)

( * ) Notice: Subject to any disclaimer, the term of this patent is extended or adjusted under 35 U.S.C. 154(b) by 0 days.

(21) Appl. No.: 12/026,727

(22) Filed: Feb. 6, 2008

(51) Int. Cl.
*H01Q 1/38* (2006.01)

(52) U.S. Cl. ..... 343/700 MS; 343/866; 343/741

(58) Field of Classification Search ..... 343/700 MS, 343/866, 741
See application file for complete search history.

(56) References Cited

U.S. PATENT DOCUMENTS 6,992,630 B2 * 1/2006 Parsche ..... 343/700 MS
7,019,699 B2 * 3/2006 Komatsu et al. ..... 343/711
7,071,878 B2 * 7/2006 Masutani ..... 343/700 MS

* cited by examiner

*Primary Examiner*—James Cho
(74) *Attorney, Agent, or Firm*—Darby & Darby P.C.

(57) ABSTRACT

A circularly polarized antenna includes a dielectric substrate, a closed-loop radiating element, a micro-strip radiating element, a feeding element, and a grounding element. The closed-loop radiating element is formed on a first surface of the dielectric substrate. The micro-strip radiating element is formed on the first surface of the dielectric substrate, is surrounded by the closed-loop radiating element, and is coupled to the closed-loop radiating element. The feeding element is formed on the first surface of the dielectric substrate, is surrounded by the closed-loop radiating element, and is coupled to the micro-strip radiating element. The grounding element is formed on a second surface of the dielectric substrate.

14 Claims, 5 Drawing Sheets

X-Z plane

Y-Z plane

CIRCULARLY POLARIZED ANTENNA

BACKGROUND OF THE INVENTION

1. Field of the Invention

This invention relates to a circularly polarized antenna, more particularly to a circularly polarized antenna that has a relatively small physical size.

2. Description of the Related Art

Numerous circularly polarized antennas of single-fed or dual-fed type have been proposed in the art. The single-fed circularly polarized antenna has a relatively narrow operating bandwidth, is not easy to adjust for impedance matching, and has a circular polarization characteristic that is difficult to alter. On the other hand, the dual-fed circularly polarized antenna has a relatively wide antenna bandwidth and a good circular polarization characteristic, but is bulky and heavy.

SUMMARY OF THE INVENTION

Therefore, the object of the present invention is to provide a circularly polarized antenna device that can overcome the aforesaid drawbacks of the prior art.

According to the present invention, a circularly polarized antenna comprises a dielectric substrate, a closed-loop radiating element, a micro-strip radiating element, a feeding element, and a grounding element. The dielectric substrate has opposite first and second surfaces. The closed-loop radiating element is formed on the first surface of the dielectric substrate. The micro-strip radiating element is formed on the first surface of the dielectric substrate, is surrounded by the closed-loop radiating element, and includes first and second segments, each of which has opposite first and second ends. The first ends of the first and second segments of the micro-strip radiating element define a first distance therebetween. The second ends of the first and second segments of the micro-strip radiating element are coupled to the closed-loop radiating element and define a second distance therebetween larger than the first distance. The feeding element is formed on the first surface of the dielectric substrate, is surrounded by the closed-loop radiating element, is coupled to the first ends of the first and second segments of the micro-strip radiating element, and is operable so as to receive an input signal, and so as to divide a power of the input signal into first and second components that are ninety-degree out-of-phase. The grounding element is formed on the second surface of the dielectric substrate.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
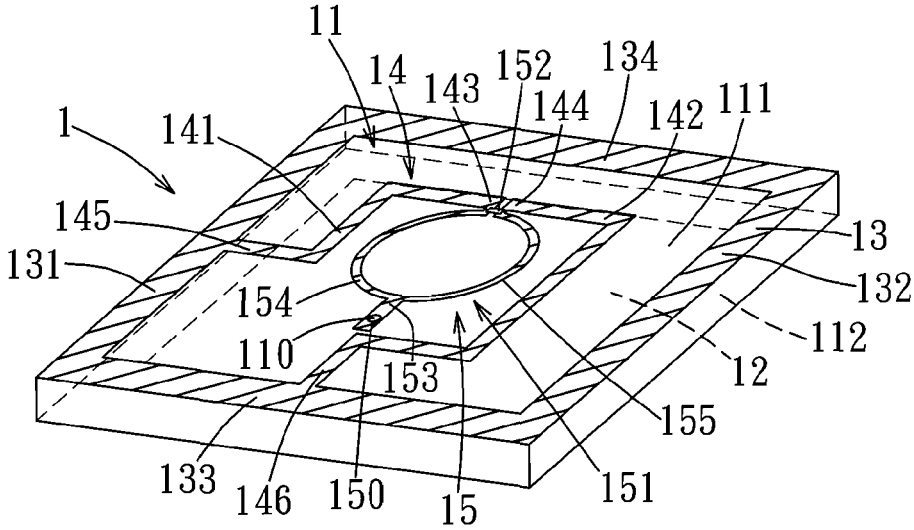
FIG. 1 is a perspective view of the preferred embodiment of a circularly polarized antenna according to the present invention.
Figure 2:
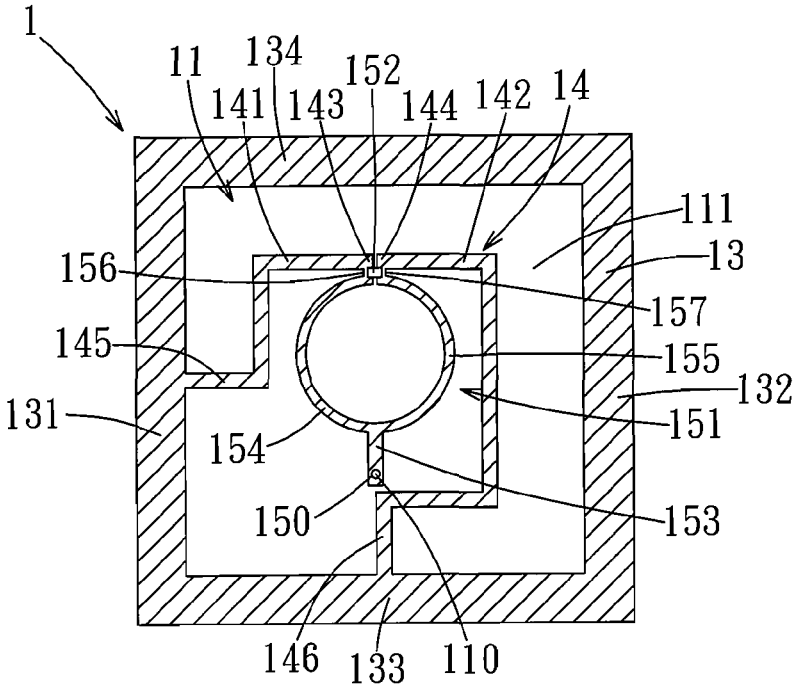
FIG. 2 is a schematic top view of the preferred embodiment of FIG. 1.

Referring to FIGS. 1 and 2, the preferred embodiment of a circularly polarized antenna 1 according to this invention is shown to include a dielectric substrate 11, a closed-loop radiating element 13, a micro-strip radiating element 14, a feeding element 15, and a grounding element 12.

The circularly polarized antenna 1 of this embodiment is operable in an operating frequency of 920 MHz.

The dielectric substrate 11 has opposite first and second surfaces 111, 112. In this embodiment, the dielectric substrate 11 has a square shape. Moreover, in this embodiment, the dielectric substrate 11 is an FR-4 substrate. Further, in this embodiment, the dielectric substrate 11 has dimensions of 95 millimeters by 95 millimeters.

In an alternative embodiment, the dielectric substrate 11 is made from a ceramic material.

In yet another embodiment, the dielectric substrate 11 has one of a circular shape and a rectangular shape.

The closed-loop radiating element 13 is formed on the first surface 111 of the dielectric substrate 11, has a square shape, and includes opposite first and second segments 131, 132 and opposite third and fourth segments 133, 134, each of which is flush with a respective one of four edges of the dielectric substrate 11. In this embodiment, each of the first, second, third and fourth segments 131, 132, 133, 134 of the closed-loop radiating element 13 has an inner edge that has a length of 76 millimeters and an outer edge that has a length of 95 millimeters.

In an alternative embodiment, the closed-loop radiating element 13 has one of a circular shape, a triangular shape, an elliptical shape, and a rectangular shape.

The micro-strip radiating element 14 is formed on the first surface 111 of the dielectric substrate 11, is surrounded by the closed-loop radiating element 13, and includes first and second segments 141, 142. The first and second segments 141, 142 of the micro-strip radiating element 14 cooperatively define an L-shape and are a quarter wavelength out of phase. In particular, each of the first and second segments 141, 142 of the micro-strip radiating element 14 has opposite first and second ends 143, 144, 145, 146. The first ends 143, 144 of the first and second segments 141, 142 of the micro-strip radiating element 14 define a first distance therebetween. The second ends 145, 146 of the first and second segments 141, 142 of the micro-strip radiating element 14 are respectively connected to midpoints of the first and third segments 131, 133 of the closed-loop radiating element 13 and define a second distance therebetween larger than the first distance. The construction as such provides a circular polarization characteristic for the circularly polarized antenna 1 of this invention. In this embodiment, each of the first and second segments 141, 142 of the micro-strip radiating element 14 is made from a metallic strip. Moreover, in this embodiment, the first and second segments 141, 142 of the micro-strip radiating element 14 have lengths of 59 millimeters and 104 millimeters, respectively.

In an alternative embodiment, the first and second segments 141, 142 of the micro-strip radiating element 14 cooperatively define an arcuate shape.

It is noted that since the second end 145 of the first segment 141 of the micro-strip radiating element 14 is connected to the first segment 131 of the closed-loop radiating element 13, the circularly polarized antenna 1 of this invention is a right hand circularly polarized (RHCP) antenna. Alternatively, when a left hand circularly polarized (LHCP) antenna is desired, the second end 145 of the first segment 141 of the micro-strip radiating element 14 may be simply connected to the second segment 132 of the closed-loop radiating element 13.

The feeding element 15 is formed on the first surface 111 of the dielectric substrate 11, is surrounded by the closed-loop radiating element 13, and includes a feeding portion 151, a pair of interconnecting members 156, 157, and a resistor 152.

The feeding portion 151 includes an input terminal 153, and first and second output terminals 154, 155. The input terminal 153 of the feeding portion 151 has a rectangular shape. The first and second output terminals 154, 155 of the feeding portion 151 cooperatively define a circular shape and are connected to the input terminal 153 of the feeding portion 151. In this embodiment, each of the input terminal 153, and the first and second output terminals 154, 155 of the feeding portion 151 is made from a metallic strip. Moreover, in this embodiment, the input terminal 153 of the feeding portion 151 has a length of 10.3 millimeters and a width of 3.0 millimeters. Further, in this embodiment, each of the first and second output terminals 154, 155 of the feeding portion 151 has a length of 48.07 millimeters and a width of 1.6 millimeters.

In an alternative embodiment, the input terminal 153 of the feeding portion 151 has one of an L-shape and a circular shape.

In yet another embodiment, the first and second output terminals 154, 155 of the feeding portion 151 cooperatively define one of an L-shape and a rectangular shape.

It is noted herein that the feeding portion 151 of the feeding element 15 is operable so as to divide a power of an input signal received by the input terminal 153 thereof into first and second components that have the same amplitude, that are ninety degrees out-of-phase, and that are respectively distributed to the first and second output terminals 154, 155 thereof.

In an alternative embodiment, the feeding portion 151 of the feeding element 15 is a power divider.

Each of the interconnecting members 156, 157 interconnects a respective one of the first and second output terminals 154, 155 of the feeding portion 151 and the first end 143, 144 of a respective one of the first and second segments 141, 142 of the micro-strip radiating element 14.

The resistor 152 has first and second terminals, each of which is connected to a respective one of the interconnecting members 156, 157. In this embodiment, the resistor 152 has a resistance of 100 Ohms.

The grounding element 12 has a shape that corresponds to that of the dielectric substrate 11, i.e., a square shape. The grounding element 12 is formed on the second surface 112 of the dielectric substrate 11, has dimensions that are less than those of the dielectric substrate 11, and is disposed at a center of the second surface 112 of the dielectric substrate 11. In this embodiment, the grounding element 12 is made from a metal sheet. Moreover, the grounding element 12 has dimensions of 64 millimeters by 64 millimeters in this embodiment.

In an alternative embodiment, the grounding element 12 has one of a rectangular shape, a circular shape, and a triangular shape.

The dielectric substrate 11 is formed with a hole 110 that extends from the first surface 111 to the second surface 112 thereof. The input terminal 153 of the feeding portion 151 is formed with a hole 150 therethrough that is aligned with the hole 110 in the dielectric substrate 11. The construction as such permits the circularly polarized antenna 1 of this invention to be mounted with an SMA connector (not shown). That is, a center conductor of the SMA connector is connected to the input terminal 153 of the feeding portion 151, and a ground conductor of the SMA connector is inserted through the holes 110, 150 and is connected to the grounding element 12. In this embodiment, the hole 150 in the input terminal 153 of the feeding portion 151 has a diameter of 1.3 millimeters.

Figure 3:
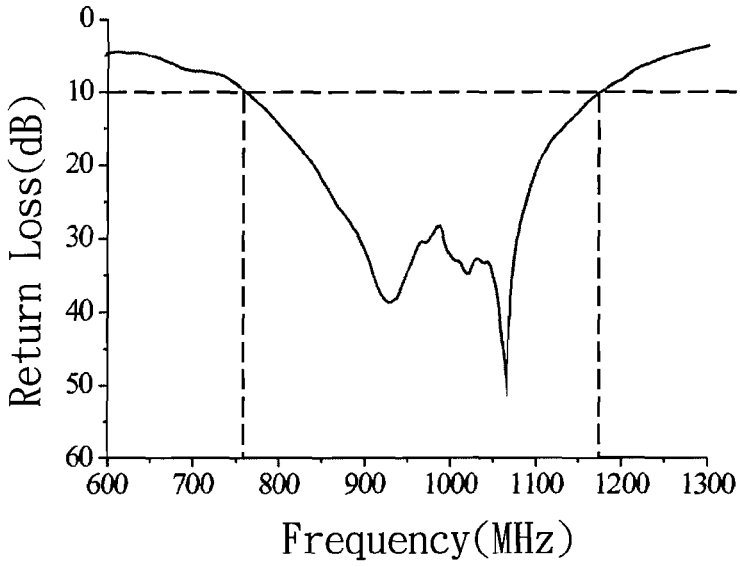
FIG. 3 is a plot illustrating a return loss of the preferred embodiment.
Figure 4:
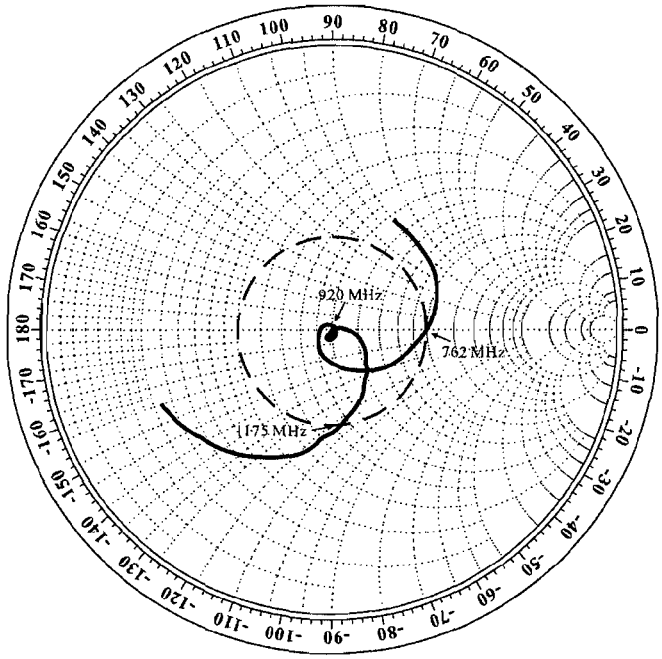
FIG. 4 is a Smith chart illustrating experimental results of the preferred embodiment.
Figure 5:
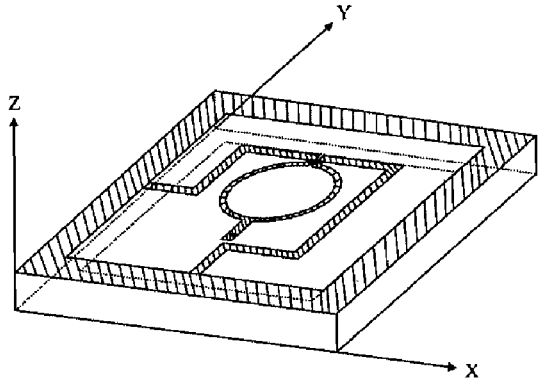
FIG. 5 shows a plot of a radiation pattern of the preferred embodiment on the x-z plane when operated at 920 MHz.
Figure 5:
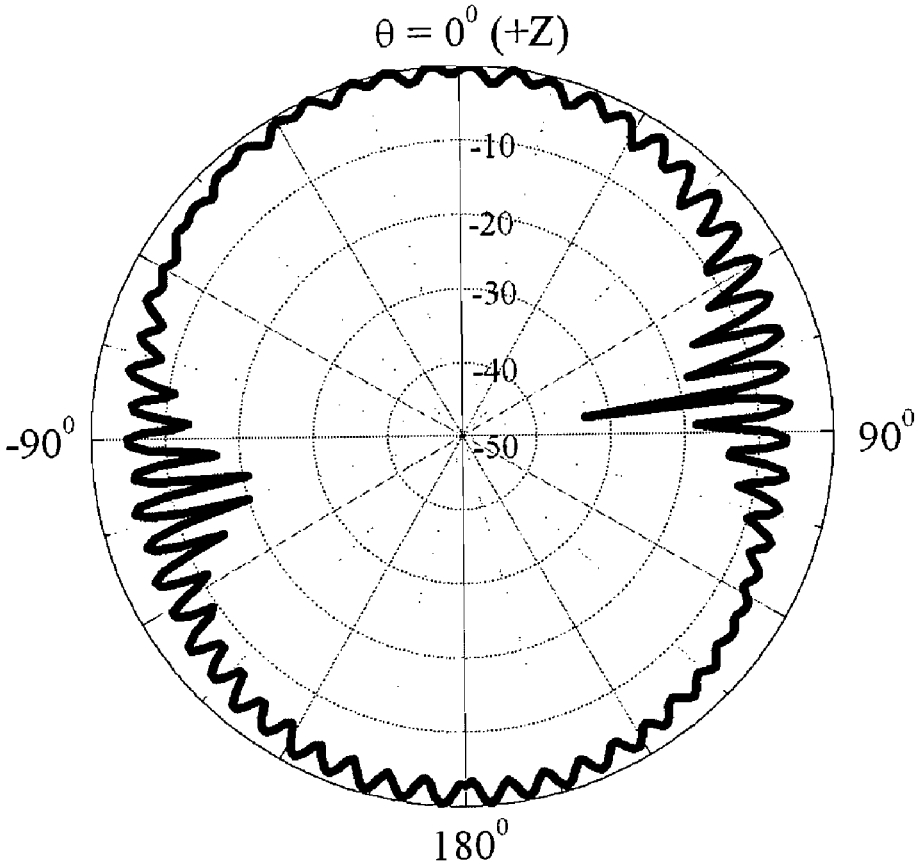
Figure 6:
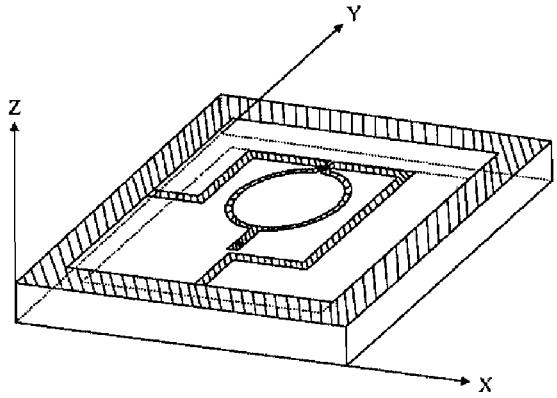
FIG. 6 shows a plot of a radiation pattern of the preferred embodiment on the y-z plane when operated at 920 MHz.
Figure 6:
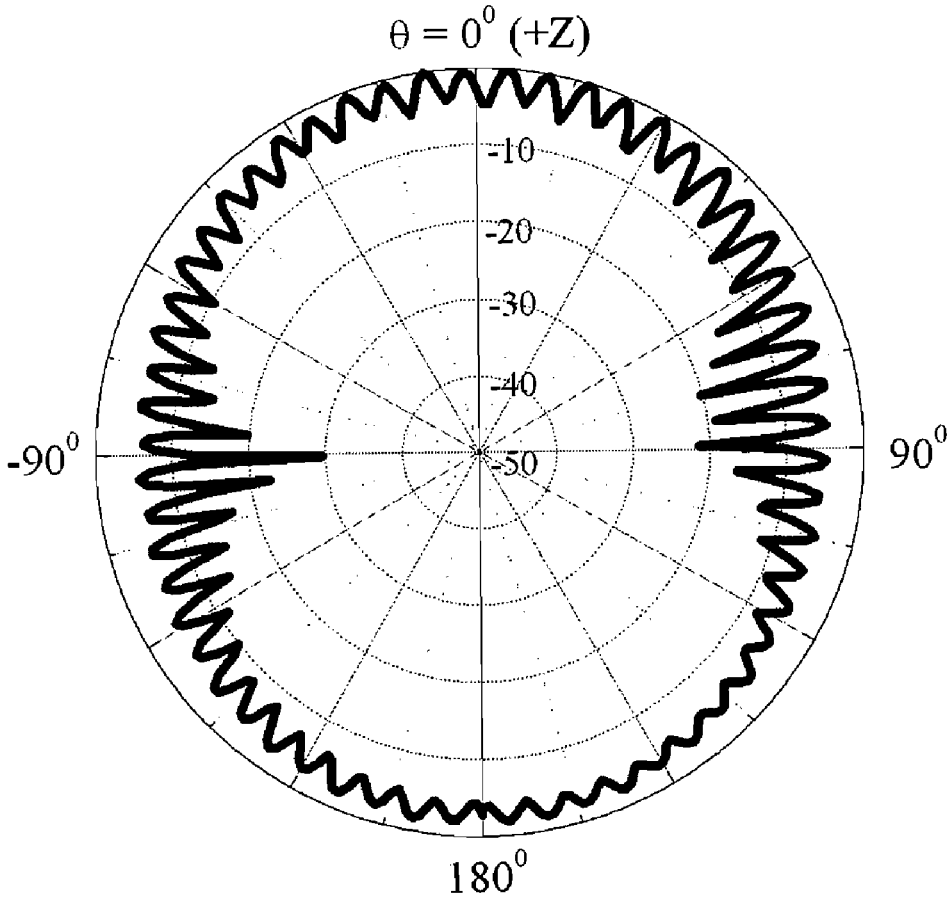
Figure 7:
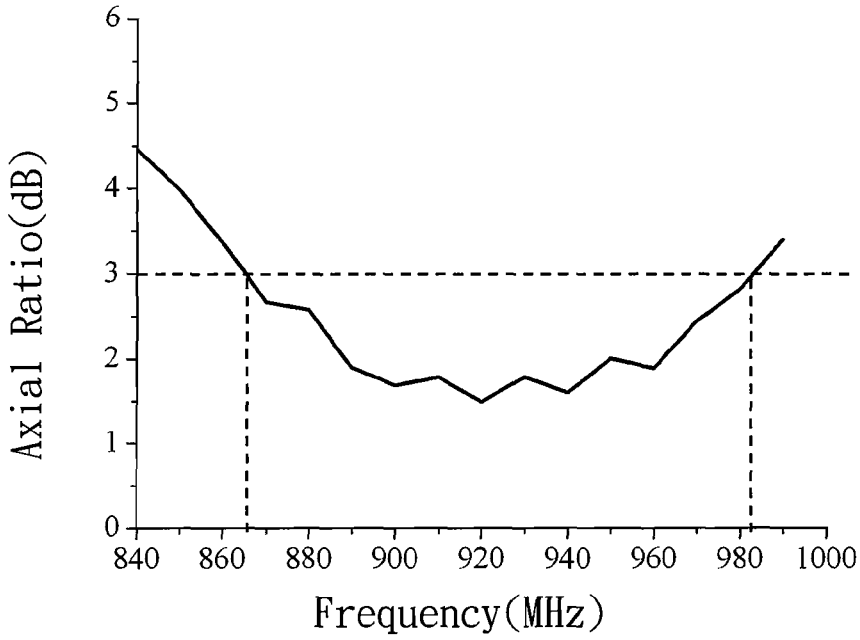
FIG. 7 is a plot illustrating an axial ratio of the preferred embodiment.
Figure 8:
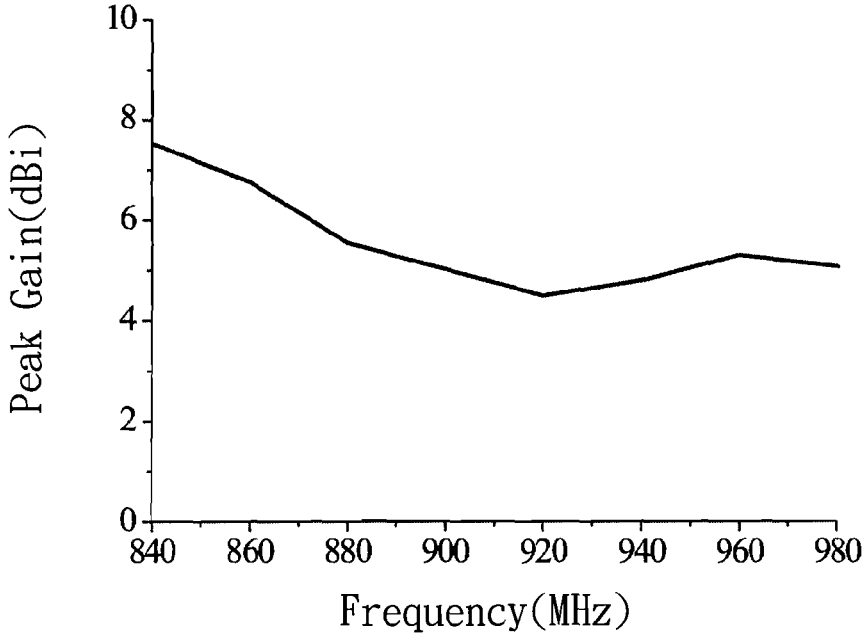
FIG. 8 is a plot illustrating a peak gain of the preferred embodiment.

Experimental results, as illustrated in FIG. 3, show that, since the return loss is greater than 10 dB from 762 MHz to 1175 MHz, the circularly polarized antenna 1 of this invention has a wide impedance bandwidth of 413 MHz. Moreover, when the circularly polarized antenna 1 of this invention is operated at the operating frequency of 920 MHz, as illustrated in FIG. 4, the circularly polarized antenna 1 achieves ninety-degree half power beamwidths in x-z and y-z planes, respectively, as illustrated in FIGS. 5 and 6. Further, as illustrated in FIG. 7, the circularly polarized antenna 1 of this invention has a wide 3-dB axial ratio bandwidth of 116 MHz, i.e., from 866 MHz to 982 MHz. In addition, as illustrated in FIG. 8, the circularly polarized antenna 1 of this invention has a high peak gain that ranges from 4.5 dBi to 6.2 dBi.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A circularly polarized antenna, comprising:

a dielectric substrate having opposite first and second surfaces;

a closed-loop radiating element formed on said first surface of said dielectric substrate;

a micro-strip radiating element formed on said first surface of said dielectric substrate, surrounded by said closed-loop radiating element, and including first and second segments, each of which has opposite first and second ends, said first ends of said first and second segments of said micro-strip radiating element defining a first distance therebetween, said second ends of said first and second segments of said micro-strip radiating element being coupled to said closed-loop radiating element and defining a second distance therebetween larger than the first distance;

a feeding element formed on said first surface of said dielectric substrate, surrounded by said closed-loop radiating element, coupled to said first ends of said first and second segments of said micro-strip radiating element, and operable so as to receive an input signal, and so as to divide a power of the input signal into first and second components that are ninety degrees out-of-phase; and a grounding element formed on said second surface of said dielectric substrate.

2. The circularly polarized antenna as claimed in claim 1, wherein said feeding element includes a feeding portion that includes an input terminal, and first and second output terminals, each of which is coupled to said input terminal, said input terminal being adapted to receive the input signal, each of said first and second output terminals being adapted to receive a respective one of the first and second components of the power of the input signal, a pair of interconnecting members, each of which interconnects a respective one of said first and second output terminals of said feeding portion and said first end of a respective one of said first and second segments of said micro-strip radiating element, and a resistor that has first and second terminals, each of which is coupled to a respective one of said interconnecting members.

3. The circularly polarized antenna as claimed in claim 2, wherein said dielectric substrate is formed with a hole that extends from said first surface to said second surface thereof, and said input terminal of said feeding portion is formed with a hole therethough that is aligned with said hole in said dielectric substrate.

4. The circularly polarized antenna as claimed in claim 2, wherein said first and second output terminals of said feeding portion cooperatively define one of a circular shape, an L-shape, and a rectangular shape.

5. The circularly polarized antenna as claimed in claim 2, wherein said feeding portion of said feeding element is a power divider.

6. The circularly polarized antenna as claimed in claim 1, wherein said first and second segments of said micro-strip radiating element are a quarter wavelength out-of-phase.

7. The circularly polarized antenna as claimed in claim 1, wherein said dielectric substrate is an FR-4 substrate.

8. The circularly polarized antenna as claimed in claim 1, wherein said dielectric substrate is made from a ceramic material.

9. The circularly polarized antenna as claimed in claim 1, wherein said dielectric substrate has one of a square shape, a rectangular shape, and a circular shape.

10. The circularly polarized antenna as claimed in claim 1, wherein said closed-loop radiating element has one of a square shape, a circular shape, a triangular shape, an elliptical shape, and a rectangular shape.

11. The circularly polarized antenna as claimed in claim 1, wherein said first and second segments of said micro-strip radiating element cooperatively define one of an L-shape and an arcuate shape.

12. The circularly polarized antenna as claimed in claim 1, wherein said first and second segments of said micro-strip radiating element cooperatively define an L-shape, and said closed-loop radiating element has a square shape, and includes opposite first and second segments and opposite third and fourth segments, said second end of said first segment of said micro-strip radiating element being coupled to one of said first and second segments of said closed-loop radiating element, said second end of said second segment of said micro-strip radiating element being coupled to said third segment of said closed-loop radiating element.

13. The circularly polarized antenna as claimed in claim 1, wherein said grounding element has one of a rectangular shape, a circular shape, and a triangular shape.

14. The circularly polarized antenna as claimed in claim 1, wherein said grounding element has a shape corresponding to that of said dielectric substrate.

* * * * *